US007012522B1

(12) United States Patent
Le Van

(10) Patent No.: US 7,012,522 B1
(45) Date of Patent: Mar. 14, 2006

(54) CHILD MONITORING SYSTEM

(76) Inventor: Katherine Le Van, 25 Mathews Rd., Newark, DE (US) 19713

( * ) Notice: Subject to any disclaimer, the term of this patent is extended or adjusted under 35 U.S.C. 154(b) by 110 days.

(21) Appl. No.: 10/358,721

(22) Filed: Feb. 5, 2003

(51) Int. Cl.
*G08B 1/08* (2006.01)

(52) U.S. Cl. ..... 340/539.15; 340/539.13; 340/539.19; 340/539.23; 340/573.4; 340/825.36; 340/825.49; 340/825.69

(58) Field of Classification Search ..... 340/573, 340/573.1, 539, 574, 539.15, 539.13, 539.23, 340/539.32, 573.4, 568.1, 825.36, 825.49, 340/539.1, 539.19, 825.69, 825.72; 342/457
See application file for complete search history.

(56) References Cited

U.S. PATENT DOCUMENTS 5,661,460 A 8/1997 Sallen et al.
5,689,240 A 11/1997 Traxler
D388,720 S 1/1998 Montgomery
5,900,817 A * 5/1999 Olmassakian ..... 340/573.1
5,939,988 A * 8/1999 Neyhart ..... 340/573.4
6,031,460 A 2/2000 Banks
6,278,370 B1 * 8/2001 Underwood ..... 340/573.1

* cited by examiner

*Primary Examiner*—Hung Nguyen

(57) ABSTRACT

A child monitoring system for allowing an adult to be alerted when a child moved beyond a specific range from the adult. The child monitoring system includes an adult assembly transmitting a monitoring signal over freespace. The adult assembly is designed for being worn by the adult. At least one child assembly receiving the monitoring signal whereby the child assembly produces an alarm sound when the child assembly detects that the monitoring signal is traveling over a distance greater than a pre-determined safe distance. The child assembly is designed for being worn by the child whereby the alarm sound emitted by the child assembly alerts others that the child has ventured to far away from the supervising adult.

16 Claims, 3 Drawing Sheets

CHILD MONITORING SYSTEM

BACKGROUND OF THE INVENTION

1. Field of the Invention

The present invention relates to distance determination systems and more particularly pertains to a new child monitoring system for allowing an adult to be alerted when a child moved beyond a specific range from the adult.

2. Description of the Prior Art

The use of distance determination systems is known in the prior art. U.S. Pat. No. 5,689,240 describes a system for allows an adult audibly monitor a child in another room. Another type of distance determination system is U.S. Pat. No. 5,661,460 having a plurality of transceiver units including a parent unit and a plurality of child units that detect the distance between the child units and the parent unit and sound an alarm when one of the child units has ventured to far away from the parent unit. U.S. Pat. No. 6,031,460 has a metal bracelet that is positioned around the wrist of a child and a second transceiver mechanism that allows an adult to locate the bracelet. U.S. Pat. No. Des. 388,720 shows a combined transmitter and receiver for locating lost individuals.

While these devices fulfill their respective, particular objectives and requirements, the need remains for a system that has certain improved features that sounds the alarm sound should the child's portion of the system be removed from the child.

SUMMARY OF THE INVENTION

The present invention meets the needs presented above by providing a child circuit member that extends through the child band member that actuates the child assembly to emit the alarm sound should the child circuit member be broken.

Still yet another object of the present invention is to provide a new child monitoring system that sounds the alarm sound should the child move to far from the supervising adult.

Even still another object of the present invention is to provide a new child monitoring system that has a button member that signal the child assembly to emit the alarm sound when the button member is actuated by the adult.

To this end, the present invention generally comprises an adult assembly transmitting a monitoring signal over freespace. The adult assembly is designed for being worn by the adult. At least one child assembly receiving the monitoring signal whereby the child assembly produces an alarm sound when the child assembly detects that the monitoring signal is traveling over a distance greater than a predetermined safe distance. The child assembly is designed for being worn by the child whereby the alarm sound emitted by the child assembly alerts others that the child has ventured to far away from the supervising adult.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
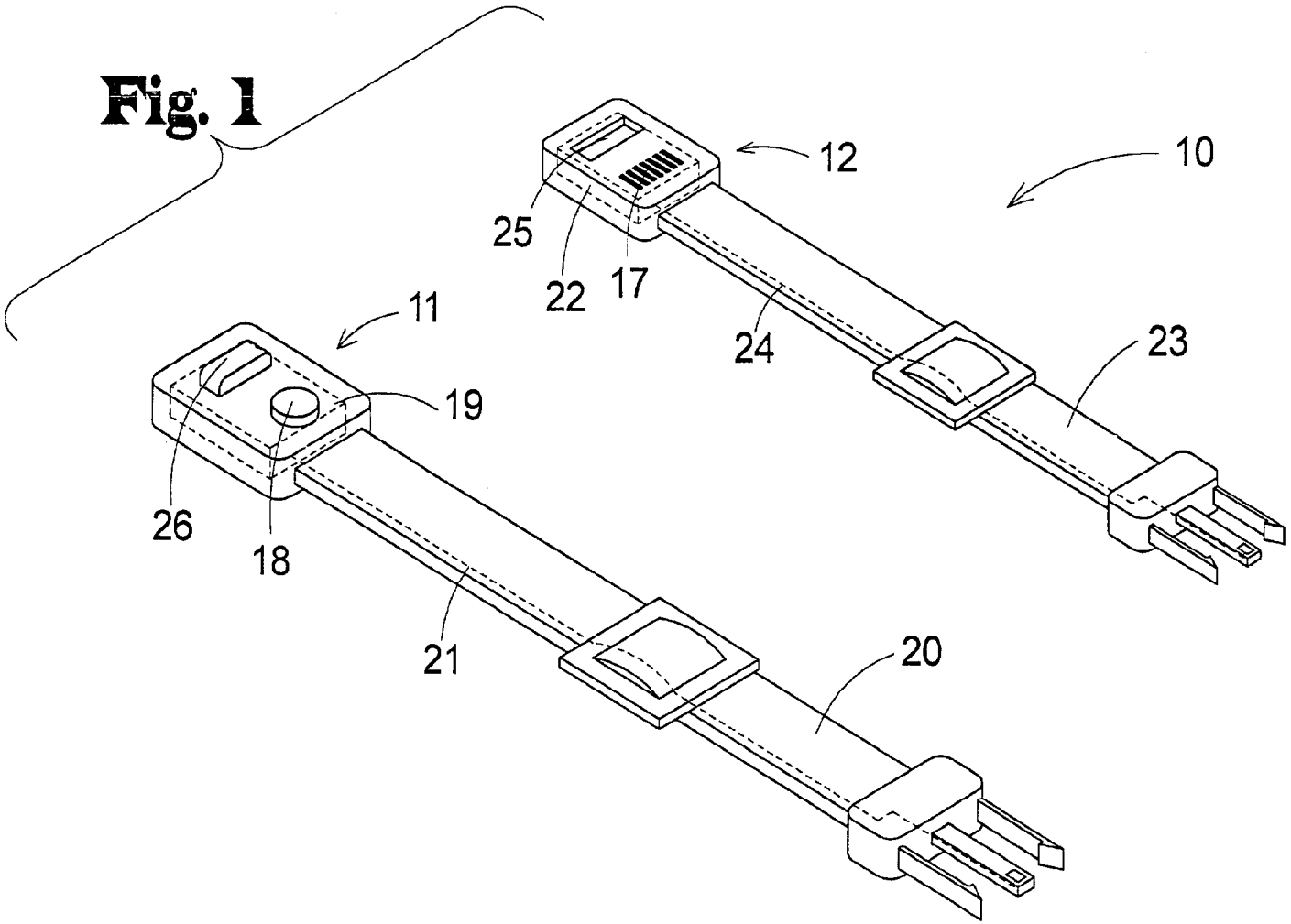
FIG. 1 is a perspective view of a new child monitoring system according to the present invention.
Figure 2:
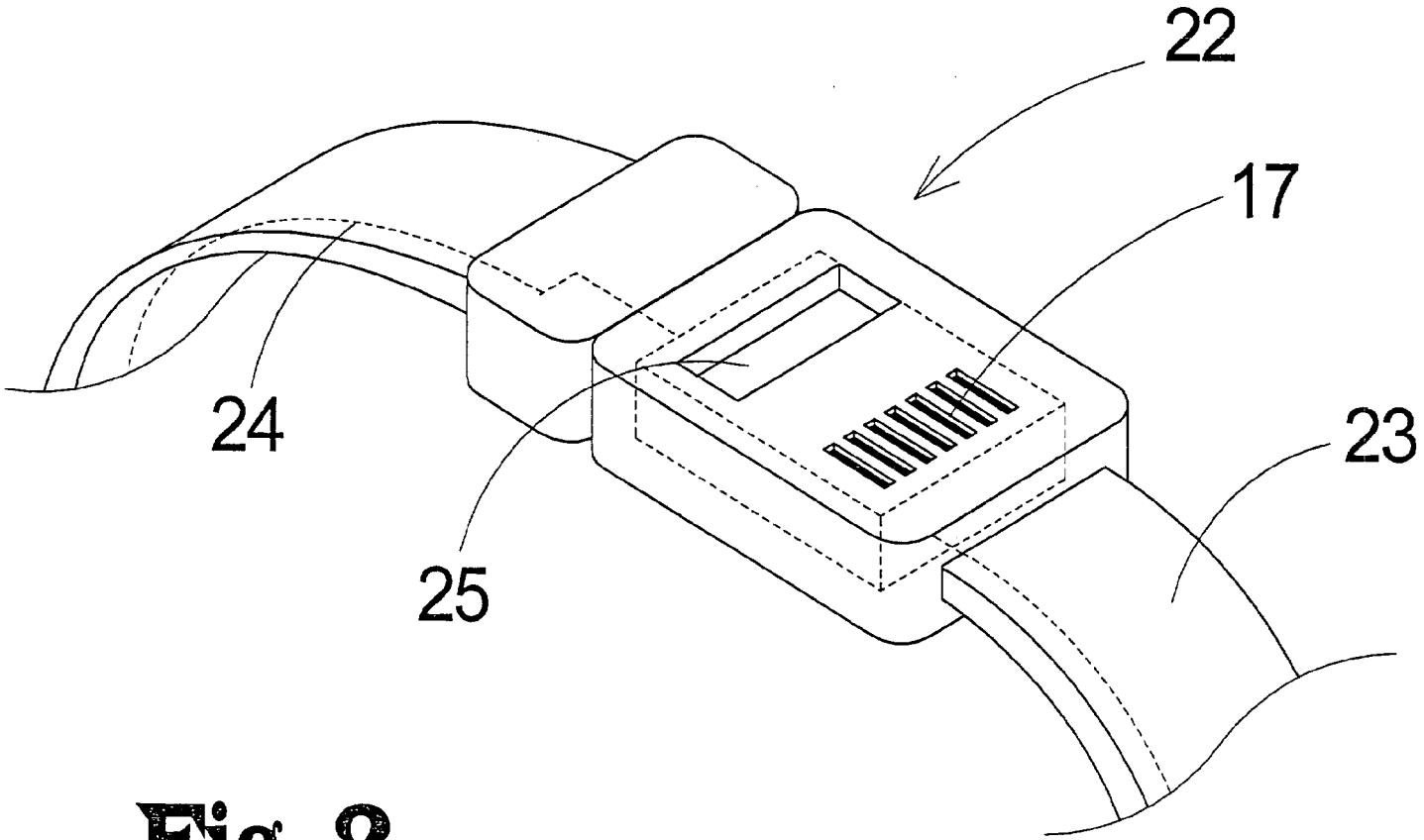
FIG. 2 is an enlarged perspective view of the child housing of the present invention.
Figure 3:
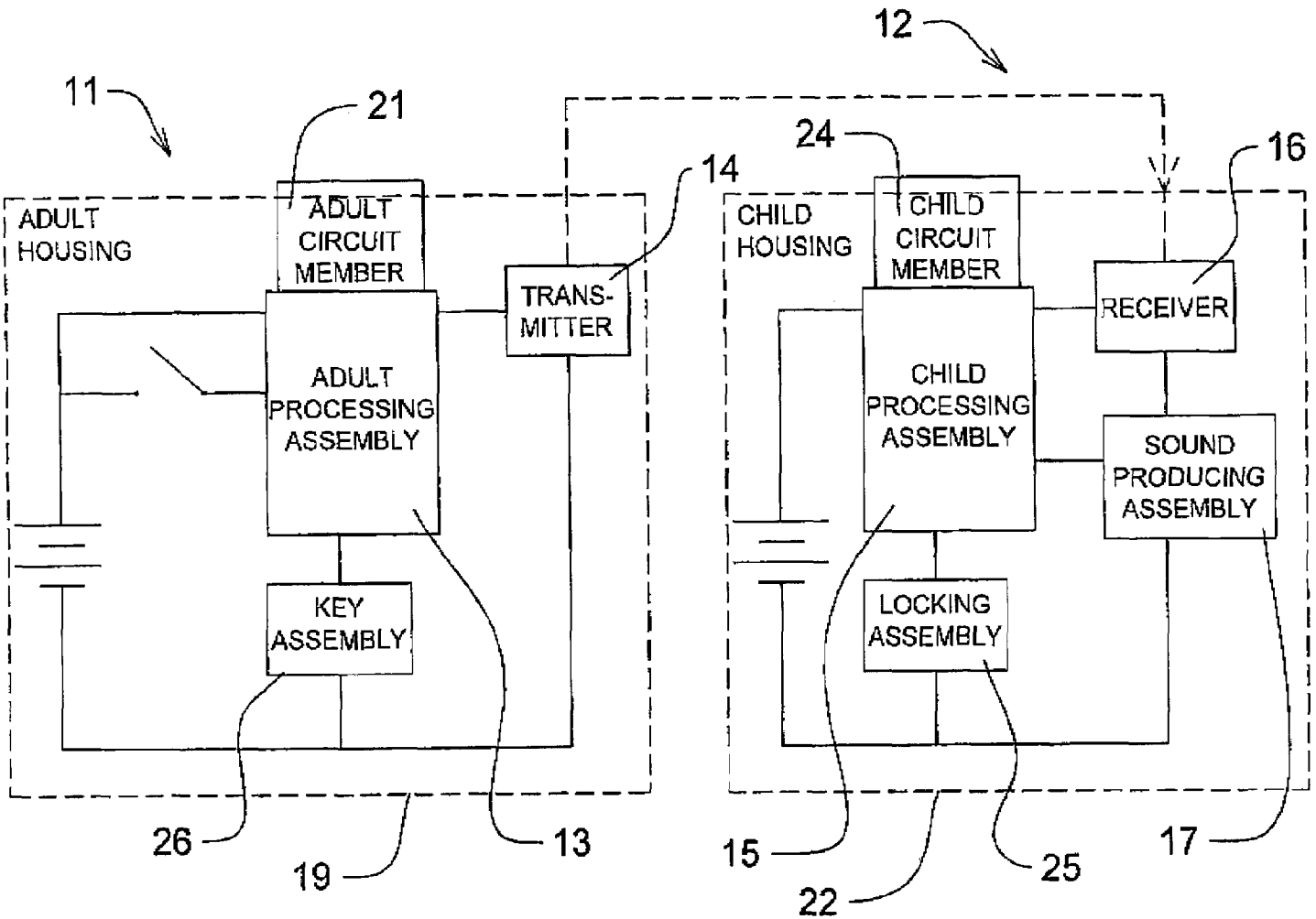
FIG. 3 is a schematic view of the present invention.

With reference now to the drawings, and in particular to FIGS. 1 through 3 thereof, a new child monitoring system embodying the principles and concepts of the present invention and generally designated by the reference numeral 10 will be described.

As best illustrated in FIGS. 1 through 3, the child monitoring system 10 generally comprises an adult assembly 11 transmitting a monitoring signal over freespace. The adult assembly 11 is designed for being worn by the adult.

At least one child assembly 12 receiving the monitoring signal whereby the child assembly 12 produces an alarm sound when the child assembly 12 detects that the monitoring signal is traveling over a distance greater than a predetermined safe distance. The child assembly 12 is designed for being worn by the child whereby the alarm sound emitted by the child assembly 12 alerts others that the child has ventured to far away from the supervising adult.

The adult assembly 11 comprises an adult processing assembly 13 and transmitter 14. The transmitter 14 is operationally coupled to the adult processing assembly 13 whereby the adult processing assembly 13 generates the monitoring signal and the transmitter 14 transmits the monitoring signal over freespace.

The child assembly 12 comprises a child processing assembly 15 and a receiver 16. The receiver 16 is operationally coupled to the child processing assembly 15 whereby the receiver 16 receives the monitoring signal transmitted by the transmitter 14 of the adult assembly 11. The child processing assembly 15 calculates the distance the monitoring signal traveled to be received by the receiver 16 of the child assembly 12 whereby the child assembly 12 emits the alarm sound when the child processing assembly 15 calculates that the monitoring signal has traveled a distance greater than the predetermined safe distance.

The child assembly 12 comprises a sound producing assembly 17. The sound producing assembly 17 is operationally coupled to the child processing assembly 15. The sound producing assembly 17 produces the alarm sound when the sound producing assembly 17 is actuated by the child processing assembly 15.

The adult assembly 11 comprises a button member 18. The button member 18 is operationally coupled to the adult processing assembly 13. The button member 18 actuates the adult processing assembly 13 to generated an activation signal to be transmitted to the child assembly 12 to actuate the child assembly 12 to produce the alarm sound when the button member 18 is actuated by the adult.

An adult housing 19 is positioned around the adult assembly 11. The adult housing 19 is designed for being selectively worn by the adult whereby the adult housing 19 selectively secures the adult assembly 11 to the adult.

An adult band member 20 is coupled to the adult housing 19. The adult band member 20 is designed for extending around an arm of the adult. The band member selectively couples to the adult housing 19 for securing the band member around the arm of the adult and securing the adult assembly 11 to the adult.

An adult circuit member 21 extends through the adult band member 20. The adult circuit member 21 is operationally coupled to the adult assembly 11 when the adult band member 20 is secured to the wrist of the adult. The adult assembly 11 transmits an alarm signal to the child assembly 12 for actuating the child assembly 12 to emit the alarm sound when the adult circuit member 21 is broken. The adult circuit member 21 and adult band member 20 being torn or cut from the adult's wrist by an aggressor would cause the child assembly 12 to emit the alarm sound.

A child housing 22 is positioned around the child assembly 12. The child housing 22 is designed for being selectively worn by the child whereby the child housing 22 selectively secures the child assembly 12 to the child.

A child band member 23 is coupled to the child housing 22. The child band member 23 is designed for extending around an arm of the child. The band member selectively coupling to the child housing 22 for securing the band member around the arm of the child and securing the child assembly 12 to the child.

A child circuit member 24 extends through the child band member 23. The child circuit member 24 is operationally coupled to the child assembly 12. The child assembly 12 emitting the alarm sound when the child circuit member 24 is broken. The child circuit member 24 and the child band member 23 being torn or cut from the child's wrist by an aggressor would cause the child assembly 12 to emit the alarm sound.

A locking assembly 25 is positioned in the child housing 22. The locking assembly 25 selectively engages the child band member 23 whereby the locking assembly 25 locks the child band member 23 to the child housing 22 when the child band member 23 is extended around the arm of the child. The locking assembly 25 is operationally coupled to the child assembly 12. The locking assembly 25 is designed for inhibiting removal of the child band member 23 from around the wrist of the child.

A key assembly 26 is operationally coupled to the adult assembly 11. The key assembly 26 is selectively engaged to the lock assembly whereby the key assembly 26 actuates the locking assembly 25 to disengage the child band member 23 when the child band member 23 is to be removed from the arm of the child. The key assembly 26 actuating the locking assembly 25 to actuate the child assembly 12 to discontinue emitting the alarm sound.

In use, the user extends the child band member 23 around the wrist of the child and secures the child band member 23 to the child housing 22. The locking assembly 25 then engages the child band member 23 and inhibits the removal of the child band member 23 from around the wrist of the child. The user then extends the adult band member 20 around their own arm and secures the adult band member 20 to the adult housing 19. The adult assembly 11 transmits the monitoring signal to the child assembly 12 and the child assembly 12 calculates distance from the adult assembly 11 that the child assembly 12 has traveled. The child assembly 12 emits the alarm sound should the child stray or be forced to move a distance from the adult greater then the determined safe distance to attract attention to the child and possible aggressor. Should either the adult band member 20 or the child band member 23 be cut or torn the adult circuit member 21 and the child circuit member 24, respectively, would cause the child assembly 12 to emit the alarm tone and attract attention. The locking assembly 25 can be disengaged from the child band member 23 abutting the key assembly 26 operationally coupled to the adult assembly 11 against the locking assembly 25 which actuates the locking assembly 25 to disengage the child band member 23 and actuates the child assembly 12 to discontinue the alarm sound.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child monitoring system for monitoring a distance of a child around an supervising adult, the child monitoring system comprising:

an adult assembly transmitting a monitoring signal over freespace, said adult assembly being adapted for being worn by the adult; and at least one child assembly receiving said monitoring signal such that said child assembly produces an alarm sound when said child assembly detects that said monitoring signal is traveling over a distance greater than a pre-determined safe distance, said child assembly being adapted for being worn by the child such that said alarm sound emitted by said child assembly alerts others that the child has ventured to far away from the supervising adult;

said adult assembly comprising an adult processing assembly and transmitter, said transmitter being operationally coupled to said adult processing assembly such that said adult processing assembly generates said monitoring signal and said transmitter transmits said monitoring signal over freespace;

said child assembly comprising a child processing assembly and a receiver, said receiver being operationally coupled to said child processing assembly such that said receiver receives said monitoring signal transmitted by said transmitter of said adult assembly, said child processing assembly calculating the distance said monitoring signal traveled to be received by said receiver of said child assembly such that said child assembly emits the alarm sound when said child processing assembly calculates that said monitoring signal has traveled a distance greater than said predetermined safe distance.

2. The child monitoring system as set forth in claim 1, further comprising:

said child assembly comprising a sound producing assembly, said sound producing assembly being operationally coupled to said child processing assembly, said sound producing assembly producing said alarm sound when said sound producing assembly is actuated by said child processing assembly.

3. The child monitoring system as set forth in claim 1, further comprising:

said adult assembly comprising a button member, said button member being operationally coupled to said adult processing assembly, said button member actuating said adult processing assembly to generate an activation signal to be transmitted to said child assembly to actuate said child assembly to produce said alarm sound when said button member is actuated by the adult.

4. The child monitoring system as set forth in claim 1, further comprising:

an adult housing being positioned around said adult assembly, said adult housing being adapted for being selectively worn by the adult such that said adult housing selectively secures said adult assembly to the adult.

5. The child monitoring system as set forth in claim 4, further comprising:

an adult band member being coupled to said adult housing, said adult band member being adapted for extending around an arm of the adult, said band member selectively coupling to said adult housing for securing said band member around the arm of the adult and securing said adult assembly to the adult.

6. The child monitoring system as set forth in claim 5, further comprising:

an adult circuit member extending through said adult band member, said adult circuit member being operationally coupled to said adult assembly when said adult band member is secured to the wrist of the adult, said adult assembly transmitting an alarm signal to said child assembly for actuating said child assembly to emit said alarm sound when said adult circuit member is broken.

7. The child monitoring system as set forth in claim 1, further comprising:

a child housing being positioned around said child assembly, said child housing being adapted for being selectively worn by the child such that said child housing selectively secures said child assembly to the child.

8. The child monitoring system as set forth in claim 7, further comprising:

a child band member being coupled to said child housing, said child band member being adapted for extending around an arm of the child, said band member selectively coupling to said child housing for securing said band member around the arm of the child and securing said child assembly to the child.

9. The child monitoring system as set forth in claim 8, further comprising:

a child circuit member extending through said child band member, said child circuit member being operationally coupled to said child assembly, said child assembly emitting said alarm sound when said child circuit member is broken.

10. The child monitoring system as set forth in claim 8, further comprising:

a locking assembly being positioned in said child housing, said locking assembly selectively engaging said child band member such that said locking assembly locks said child band member to said child housing when said child band member is extended around the arm of the child, said locking assembly being operationally coupled to said child assembly, said locking assembly being adapted for inhibiting removal of said child band member from around the wrist of the child.

11. The child monitoring system as set forth in claim 10, further comprising:

a key assembly being operationally coupled to said adult assembly, said key assembly being selectively engaged to said lock assembly such that said key assembly actuates said locking assembly to disengage said child band member when said child band member is to be removed from the arm of the child, said key assembly actuating said locking assembly to actuate said child assembly to discontinue emitting said alarm sound.

12. A child monitoring system for monitoring a distance of a child around an supervising adult, the child monitoring system comprising:

an adult assembly transmitting a monitoring signal over freespace, said adult assembly being adapted for being worn by the adult;

at least one child assembly receiving said monitoring signal such that said child assembly produces an alarm sound when said child assembly detects that said monitoring signal is traveling over a distance greater than a pre-determined safe distance, said child assembly being adapted for being worn by the child such that said alarm sound emitted by said child assembly alerts others that the child has ventured to far away from the supervising adult;

said adult assembly comprising an adult processing assembly and transmitter, said transmitter being operationally coupled to said adult processing assembly such that said adult processing assembly generates said monitoring signal and said transmitter transmits said monitoring signal over freespace;

said child assembly comprising a child processing assembly and a receiver, said receiver being operationally coupled to said child processing assembly such that said receiver receives said monitoring signal transmitted by said transmitter of said adult assembly, said child processing assembly calculating the distance said monitoring signal traveled to be received by said receiver of said child assembly such that said child assembly emits the alarm sound when said child processing assembly calculates that said monitoring signal has traveled a distance greater than said predetermined safe distance;

said child assembly comprising a sound producing assembly, said sound producing assembly being operationally coupled to said child processing assembly, said sound producing assembly producing said alarm sound when said sound producing assembly is actuated by said child processing assembly;

said adult assembly comprising a button member, said button member being operationally coupled to said adult processing assembly, said button member actuating said adult processing assembly to generated an activation signal to be transmitted to said child assembly to actuate said child assembly to produce said alarm sound when said button member is actuated by the adult;

an adult housing being positioned around said adult assembly, said adult housing being adapted for being selectively worn by the adult such that said adult housing selectively secures said adult assembly to the adult;

an adult band member being coupled to said adult housing, said adult band member being adapted for extending around an arm of the adult, said band member selectively coupling to said adult housing for securing said band member around the arm of the adult and securing said adult assembly to the adult;

an adult circuit member extending through said adult band member, said adult circuit member being operationally coupled to said adult assembly when said adult band member is secured to the wrist of the adult, said adult assembly transmitting an alarm signal to said child assembly for actuating said child assembly to emit said alarm sound when said adult circuit member is broken;

a child housing being positioned around said child assembly, said child housing being adapted for being selectively worn by the child such that said child housing selectively secures said child assembly to the child;

a child band member being coupled to said child housing, said child band member being adapted for extending around an arm of the child, said band member selectively coupling to said child housing for securing said band member around the arm of the child and securing said child assembly to the child;

a child circuit member extending through said child band member, said child circuit member being operationally coupled to said child assembly, said child assembly emitting said alarm sound when said child circuit member is broken;

a locking assembly being positioned in said child housing, said locking assembly selectively engaging said child band member such that said locking assembly locks said child band member to said child housing when said child band member is extended around the arm of the child, said locking assembly being operationally coupled to said child assembly, said locking assembly being adapted for inhibiting removal of said child band member from around the wrist of the child; and a key assembly being operationally coupled to said adult assembly, said key assembly being selectively engaged to aid lock assembly such that said key assembly actuates said locking assembly to disengage said child band member when said child band member is to be removed from the arm of the child, said key assembly actuating said locking assembly to actuate said child assembly to discontinue emitting said alarm sound.

13. A child monitoring system for monitoring a distance of a child around an supervising adult, the child monitoring system comprising:

an adult assembly transmitting a monitoring signal over freespace, said adult assembly being adapted for being worn by the adult;

at least one child assembly receiving said monitoring signal such that said child assembly produces an alarm sound when said child assembly detects that said monitoring signal is traveling over a distance greater than a pre-determined safe distance, said child assembly being adapted for being worn by the child such that said alarm sound emitted by said child assembly alerts others that the child has ventured to far away from the supervising adult;

an adult housing being positioned around said adult assembly, said adult housing being adapted for being selectively worn by the adult such that said adult housing selectively secures said adult assembly to the adult;

an adult band member being coupled to said adult housing, said adult band member being adapted for extending around an arm of the adult, said band member selectively coupling to said adult housing for securing said band member around the arm of the adult and securing said adult assembly to the adult;

an adult circuit member extending through said adult band member, said adult circuit member being operationally coupled to said adult assembly when said adult band member is secured to the wrist of the adult, said adult assembly transmitting an alarm signal to said child assembly for actuating said child assembly to emit said alarm sound when said adult circuit member is broken;

a child housing being positioned around said child assembly, said child housing being adapted for being selectively worn by the child such that said child housing selectively secures said child assembly to the child;

a child band member being coupled to said child housing, said child band member being adapted for extending around an arm of the child, said band member selectively coupling to said child housing for securing said band member around the arm of the child and securing said child assembly to the child; and a child circuit member extending through said child band member, said child circuit member being operationally coupled to said child assembly, said child assembly emitting said alarm sound when said child circuit member is broken;

said adult assembly comprising an adult processing assembly and transmitter, said transmitter being operationally coupled to said adult processing assembly such that said adult processing assembly generates said monitoring signal and said transmitter transmits said monitoring signal over freespace;

said child assembly comprising a child processing assembly and a receiver, said receiver being operationally coupled to said child processing assembly such that said receiver receives said monitoring signal transmitted by said transmitter of said adult assembly, said child processing assembly calculating the distance said monitoring signal traveled to be received by said receiver of said child assembly such that slid child assembly emits the alarm sound when said child processing assembly calculates that said monitoring signal has traveled a distance greater than said predetermined safe distance.

14. The child monitoring system as set forth in claim 13, further comprising:

said child assembly comprising a sound producing assembly, said sound producing assembly being operationally coupled to said child processing assembly, said sound producing assembly producing said alarm sound when said sound producing assembly is actuated by said child processing assembly.

15. The child monitoring system as set forth in claim 13, further comprising:

a locking assembly being positioned in said child housing, said locking assembly selectively engaging said child band member such that said locking assembly locks said child band member to said child housing when said child band member is extended around the arm of the child, said locking assembly being operationally coupled to said child assembly, said locking assembly being adapted for inhibiting removal of said child band member from around the wrist of the child.

16. The child monitoring system as set forth in claim 15, further comprising:

a key assembly being operationally coupled to said adult assembly, said key assembly being selectively engaged to said lock assembly such that said key assembly actuates said locking assembly to disengage said child band member when said child band member is to be removed from the arm of the child, said key assembly actuating said locking assembly to actuate said child assembly to discontinue emitting said alarm sound.

* * * * *